United States Patent [19]

Sluys

[11] 4,357,891

[45] Nov. 9, 1982

[54] FLOATING MOORAGE DEVICE FOR USE WITH PILES OR DOLPHINS

[75] Inventor: Wesley W. Sluys, Bellingham, Wash.

[73] Assignee: Builders Concrete, Inc., Bellingham, Wash.

[21] Appl. No.: 94,669

[22] Filed: Nov. 15, 1979

[51] Int. Cl.[3] ..... B63B 21/00

[52] U.S. Cl. ..... 114/230; 114/219

[58] Field of Search ..... 114/219, 220, 230; 405/212, 213, 215

[56] References Cited

U.S. PATENT DOCUMENTS

| | | | |
|---|---|---|---|
| 2,562,957 | 8/1951 | Sipkin et al. | 114/219 |
| 3,430,598 | 3/1969 | Soderberg | 114/230 |
| 3,486,342 | 12/1969 | Aks | 114/230 |
| 3,848,853 | 11/1974 | Way et al. | 114/219 X |
| 3,950,806 | 4/1976 | Puchois | 114/230 X |
| 4,098,212 | 7/1978 | Kemper et al. | 114/230 |

*Primary Examiner*—Charles A. Marmor

*Attorney, Agent, or Firm*—Seed, Berry, Vernon & Baynham

[57] ABSTRACT

A floating mooring device adapted to be used with one or more piles projecting upwardly in a body of water. The device includes a float which is fastened to a cylindrical collar loosely surrounding the piles so that the float can move upwardly or downwardly along the pile in response to tidal action. A conventional mooring cleat or ring is carried by either the float or collar to which a line extending from a moored vessel may be fastened. Since vertical movement of the vessel responsive to tidal action is matched by the vertical movement of the float, the line may be tautly fastened to the float in order to prevent excessive movement of the vessel, yet tension of the line remains constant responsive to tidal action. The embodiment of the device used with a single pile includes a cylindrical float extending around a cylindrical inner sleeve which loosely surrounds the pile. In one embodiment the float is formed by an outer sleeve concentrically surrounding the inner sleeve with the space therebetween being either hollow or filled with a buoyant material. In another embodiment the float is formed by a plurality of axially spaced tires filled with a buoyant material surrounding the inner shell. The embodiment used with a pair of spaced-apart parallel piles or dolphins includes three interconnected collars, two of which loosely surround the pile, with the remaining collar being tightly secured to an elongated, cylindrical float.

6 Claims, 7 Drawing Figures

FLOATING MOORAGE DEVICE FOR USE WITH PILES OR DOLPHINS

BACKGROUND OF THE INVENTION

1. Field of the Invention

This invention relates to docking facilities for vessels, and more particularly, to a moorage device for securing a line carried by a vessel to a pile at a location on the pile which is horizontally fixed yet moves vertically with vertical movement of the vessel responsive to tidal action.

2. Description of the Prior Art

Floating moorage is commonly used in marinas throughout the United States. Such moorage utilizes a relatively wide mainwalk float projecting outwardly from the shore and a large number of relatively narrow finger floats of varying lengths projecting perpendicularly from the mainwalk float at spaced-apart locations. This commonly used mooring arrangement works very well for fairly small boats, but tidal surges often cause damage to floats when longer finger floats required by larger boats are used. The tidal action in most West Coast ports is not smooth or slowly varying. Instead, tidal surges; i.e., waves or water level variations, are generally produced which may have an amplitude of between one and six feet. The larger size of the finger floats required for the larger boats often causes the vertical movement of the larger boats to lose synchronization with the vertical movement of the mainwalkway floats. Under these circumstances, the larger boats move upwardly on the surge when the floating mainwalk piers are moving downwardly. This action causes the boat to collide into the mainwalk and finger floats often with sufficient force to cause severe damage to boeth the vessel and float. The more serious surges frequently occur during the winter months at times when moored vessels are often unattended. Consequently, widespread damage often occurs before it is discovered.

The surge problem has, in many cases, prevented the use of the above-described floating moorage for larger vessels. Instead, a single floating mainwalk is used and a larger number of spaced-apart piles or groups of piles known as "dolphins" are driven into the sea bed along a line spaced from the edge of the mainwalk a distance approximately equal to the length of the vessels. The use of extra pile or dolphins cannot solve the surge problem and sometimes produce other problems as a result from a combination of surge plus tidal and wave action. It is desirable to prevent moored vessels from moving either transversely or longitudinally so that the vessel does not strike either the piles or the mainwalk. Consequently, lines extending between the vessel and the piles should be taut. However, taut lines extending around the piles often bind on the piles so that the lines are not able to move vertically along the pile as the vessel moves vertically responsive to tidal action. This results in extreme forces exerted on the pile by the boat which are frequently of sufficient magnitude to dislodge the pile from the sea floor. The vessel can then drift about with the pile, potentially causing a great deal of damage. Use of mainwalk and pile moorage thus presents the vessel operator with two options, neither of which is entirely satisfactory. The mooring lines can be left loose, in which case the vessel is free to move longitudinally or transversely to strike the mainwalk or piles; or the mooring line can be made taut, thereby risking removal of the pile from the sea floor.

Floating tie-up buoys have been developed and used commercially. However, these buoys are generally either floats which are loosely anchored to the sea floor and thus do not restrict boat movement or they are cylindrical floats loosely positioned in vertical slots formed along the walls of locks. Neither of these existing float structures are satisfactory for use with a pile or dolphin to allow a vessel to be securely moored at a pile and yet respond to tidal changes. A structure attempting to solve the above-described problems is shown in *Standard Handbook of Civil Engineers,* Frederick S. Merritt, page 23–61. One such attempt includes a rod extending vertically along the side of a pile. A mooring ring loosely surrounds the rod for free vertical movement. This structure does not employ a float nor is it strong enough for extreme weather particularly where the rod must be long enough to accommodate the large tides ranges frequently found in many areas.

SUMMARY OF THE INVENTION

It is an object of the invention to provide a floating moorage device which allows a line extending from a vessel to be as taut as necessary to prevent longitudinal or transverse drift while accommodating vertical movements of the vessel resulting from tidal action.

It is another object of the invention to provide a floating mooring device of the character described which can be easily retrofitted to existing moorage facilities.

It is a different object of the invention to provide a floating mooring device which can prolong the life of the mooring float system and eliminate costly maintenance by preventing physical abuse to the floats.

It is an additional object of the invention to provide a floating mooring device which can enable the development of new harbors or enlargement of existing harbors in areas where tidal or surge action has heretofor prevented the safe moorage of vessels without the environmentally unacceptable and cost-prohibitive addition of fixed breakwater protection.

It is still another object of the invention to provide a mooring device which can be used with either a single guide pile or a pair of parallel piles.

It is a further object of the invention to provide a floating mooring device of the character described which is relatively inexpensive, easy to fabricate, or may use discarded tires.

These and other objects of the invention are provided by a mooring device for use with a pile projecting upwardly in a body of water. The device includes an inner shell which loosely surrounds the pile. A float surrounds the shell and carries a conventional mooring device such as a cleat or mooring ring. The float may be formed by a cylindrical outer shell concentrically fastened to the inner shell by interconnecting means. The space between the inner and outer shells may be either hollow or filled with a buoyant material to cause the device to float in water. Additionally, an annular resilient fender may extend circumferentially around the outer shell above the water line. The outer shell may be secured to the inner shell by an annular plate extending between the upper edges of the shells with the lower portions of the shells being interconnected by circumferentially spaced ribs. The float may also be formed by several axially stacked tires filled with a buoyant material which are concentrically secured to the inner shell.

The tires may be connected to the inner shell and to each other by placing elongated fastening members through the side walls of the tires and securing the upper ends of the fastening members to an annular plate which extends outwardly from the inner shell to overlap the tires. The float can also be formed into shapes other than round, to fit non-cylindrical piles. The floating mooring device used with a pair of spaced-apart parallel pile includes a float and a pair of vertically spaced retainer members secured to the float which loosely surround the pile to allow the float to remain on the surface of the water during wave or tidal action. The retaining members may include three interconnected collars, two of which loosely surround respective pile, with the remaining collar being tightly secured to the float. A connecting plate extending between the collars of each retaining member may carry a conventional mooring device such as a cleat or mooring ring.

DETAILED DESCRIPTION OF THE INVENTION

Figure 1:
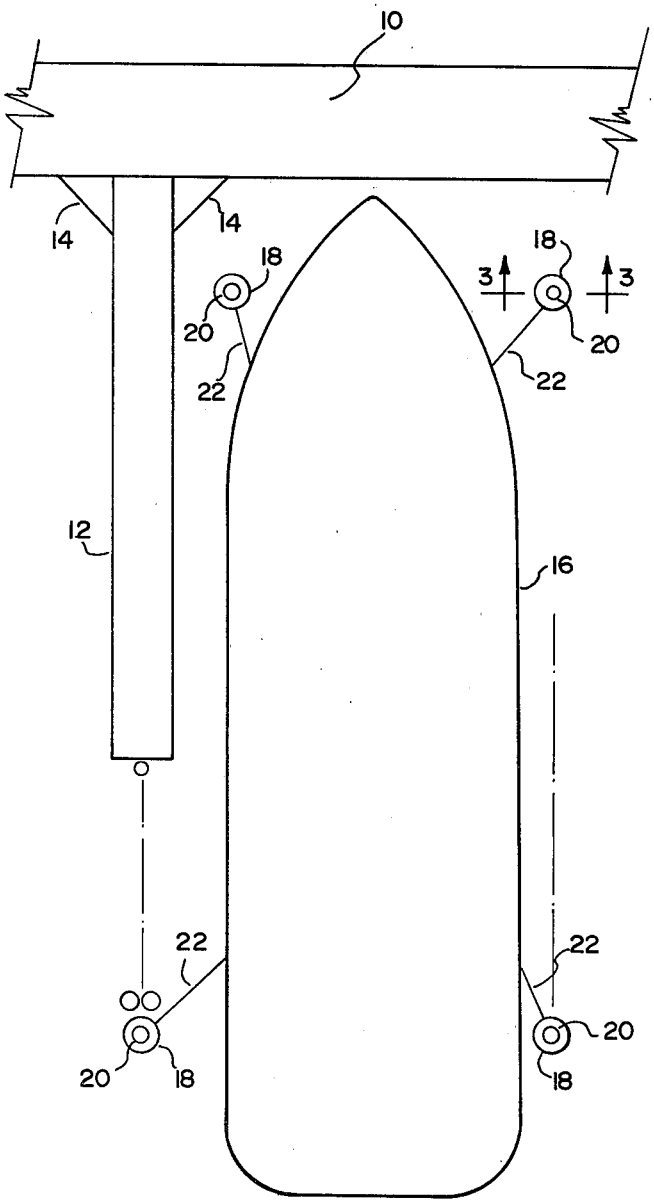
FIG. 1 is a top plan view of a mooring facility employing the inventive floating mooring device.

A typical moorage facility which may utilize the inventive floating mooring device is illustrated in FIG. 1. The facility includes a conventional mainwalk 10 formed by a plurality of conventional mainwalk floats. A relatively short, narrow finger float 12 projects perpendicularly from the mainwalk 10 and is secured thereto by triangularly shaped gussets 14. A fairly large vessel 16, which may be on the order of 50 feet or more in length, is positioned adjacent the finger float 12. It must be emphasized, however, that the vessel 16 is not tied to the finger float 12 so the aforementioned impact problem cannot occur. Instead, the vessel 16 is secured to four of the inventive floating mooring devices 18 surrounding respective piles 20 by taut lines 22. Since the lines 22 are taut, the vessel is incapable of moving either longitudinally or transversely so that it will not strike either the mainwalk 10, the finger float 12 or the pile 20 even when relatively large waves or vessel wakes are encountered. However, since the mooring device 18 floats at the surface of the water as described hereinafter, the tension on lines 22 does not vary as the vertical position of the vessel 16 varies responsive to tidal action.

Figure 2:
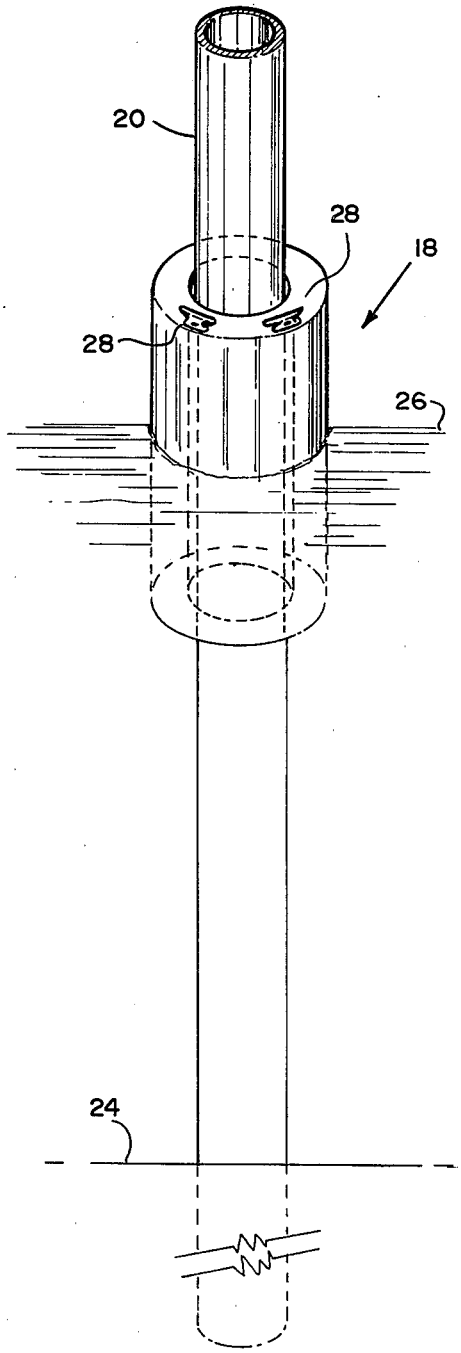
FIG. 2 is an isometric view showing one embodiment of the mooring device carried by a single upstanding pile.

An isometric view of one embodiment of the mooring device of FIG. 1 is illustrated in FIG. 2. The pile 20 is driven into the sea floor 24 a suitable distance by conventional means so that it is relatively immovable. The mooring device 18, which loosely surrounds the pile 20, projects for about 40 percent of its length above waterline 26, while the remaining 60 percent is submerged. It will be understood, however, that the degree to which the device 18 is submerged is not critical so long as at least a portion of it is at or above the waterline 26. A pair of conventional mooring cleats 28 are mounted on the upper surface of the float 18 to allow the lines 22 to be secured to the device 18.

Figure 3:
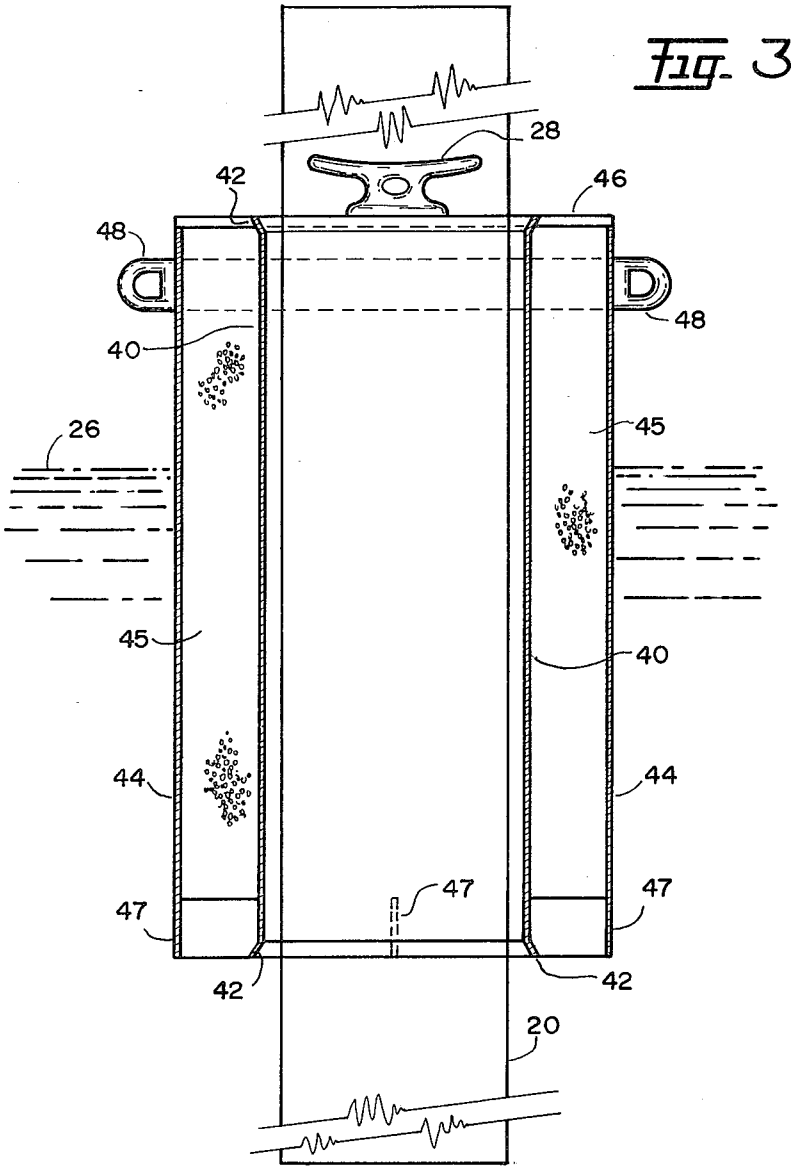
FIG. 3 is a cross-sectional view of the mooring device of FIG. 2.

The structural details of the embodiment of FIGS. 1 and 2 are illustrated in FIG. 3. An inner shell 40, which is preferably a length of tubular pipe, surrounds the pile 20. The inside diameter of the inner shell 40 is sufficiently larger than the outside diameter of the pile 20 so that it is free to move vertically along the pile 20. The upper and lower edges of the shell 40 are chamfered outwardly at 42 to ensure that the edges do not dig into or catch the sides of the pile 20. An outer shell 44, which may also be a length of tubular pipe, concentrically surrounds the inner shell 40. The outer shell 44 is connected to the inner shell 40 by an annular plate 46 extending between the upper edges of the inner and outer shells 40, 44, respectively are preferably interconnected by circumferentially spaced ribs or spokes 47 particularly where the space between the inner and outer shells 40, 44, respectively, particularly where the space between the inner and outer shells 40, 44, respectively, is hollow. However, this space may be filled with a buoyant material 45 such as polystyrene or similar foam which maintains the concentric positioning of the shells 40, 44, thus making the ribs 47 unnecessary. If desired, an annular resilient fender 48 may be secured about the outer shell 44 above the waterline 24. The fender 48 may be formed of any suitable resilient material, such as rubber, resilient plastic or the like. The mooring cleat 28, illustrated in FIG. 2, is mounted on the annular plate 46 by suitable fasteners. Other conventional marine fixtures such as mooring rings may also be mounted on either the annular plate 46 or the outer surface of the outer shell 44.

Figure 4:
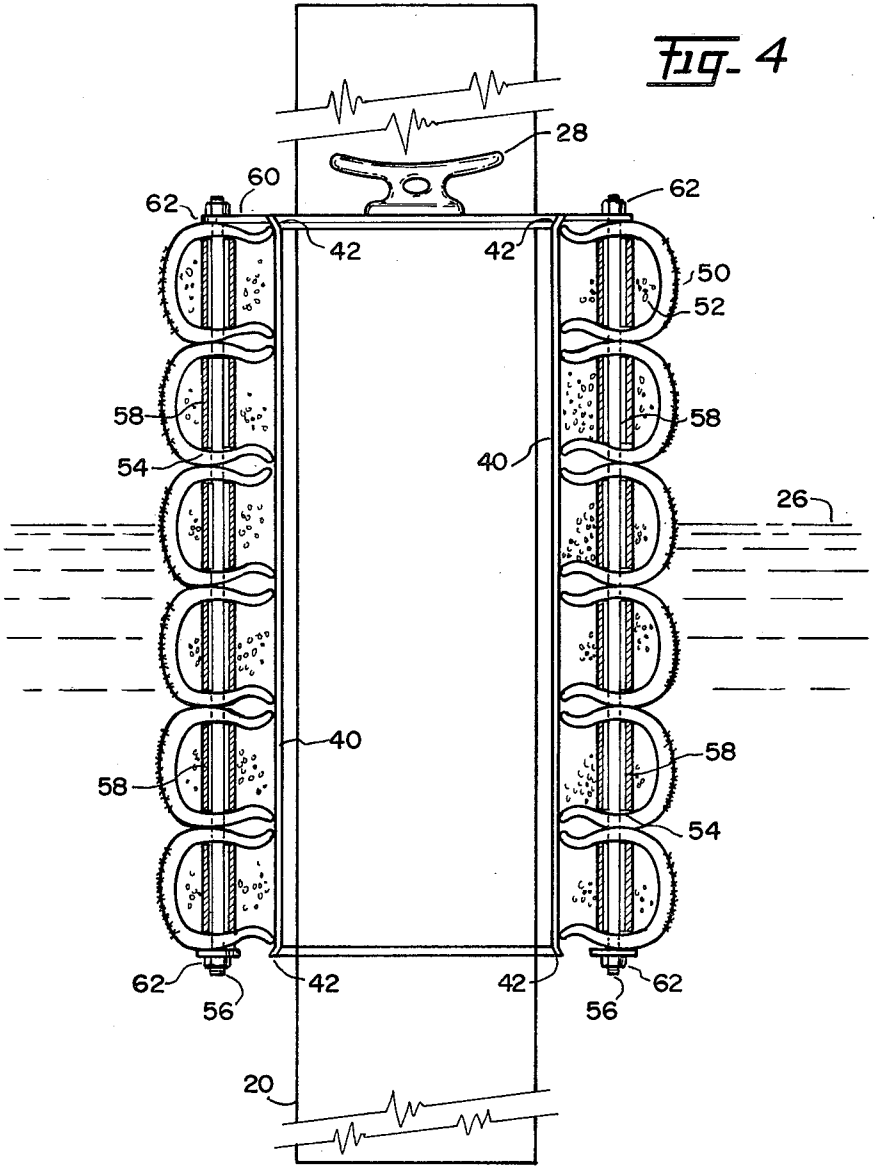
FIG. 4 is a cross-sectional view of an alternative embodiment of the mooring device used with a single upstanding pile.

An alternative embodiment of the mooring device is illustrated in FIG. 4 in which features which are identical to the embodiment of FIG. 3 are identically numbered. The basic difference between the embodiment of FIG. 4 and the embodiment of FIGS. 1–3 is that the embodiment of FIG. 4 employs as a float a plurality of axially spaced tires 50 filled with a buoyant material 52 which surround the inner shell 40. The side walls of the tires 50 have formed therein aligned holes 54 through which extends rods 56. Individual tubular spacers 58 are imbedded in the buoyant material 52 in alignment with the holes 54. The spacers 58 have a diameter which is substantially larger than the diameter of the either the rod 56 or the holes 54 so that the spacers 58 clamp the side walls of the tires 50 when the spacers are compressed as explained hereinafter. The rod 56 projects through holes formed in an annular plate 60 which is fastened to the upper edge of the inner shell 40 such as by welding. Nuts 62 are tightened onto the ends of the rods 56 so that when the nuts 62 are threaded toward each other the spacers 58 clamp the side walls of the tires 50 as explained above and secure the tires to the annular plate. The primary advantages of this embodiment are that it utilizes a waste material, namely, spent tires, and the tires provide a resiliency to act as a resilient fender.

Figure 5:
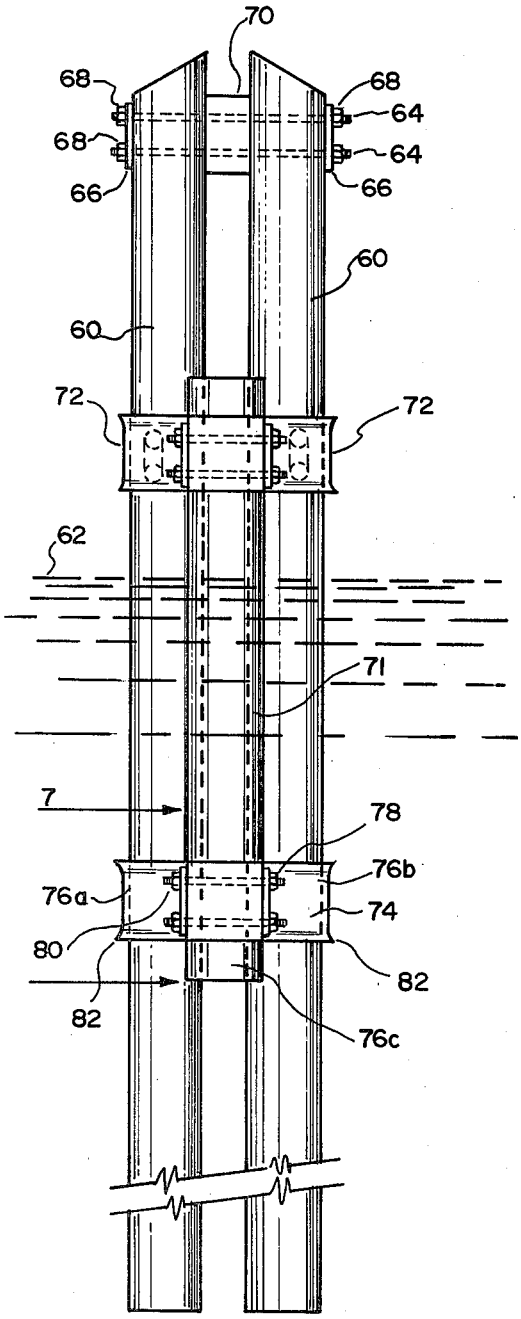
FIG. 5 is an elevation view of a third embodiment of the mooring device used with a pair of spaced-apart, parallel upstanding piles.
Figure 6:
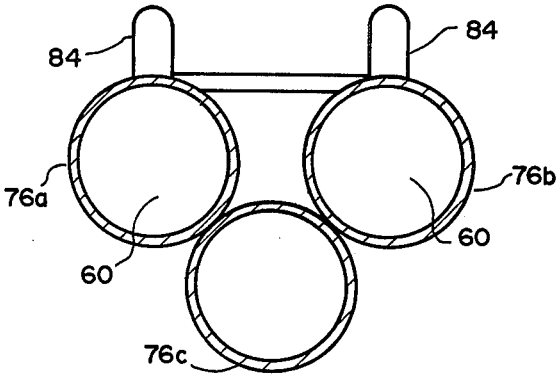
FIG. 6 is a top plan view of the mooring device of FIG. 5.
Figure 7:
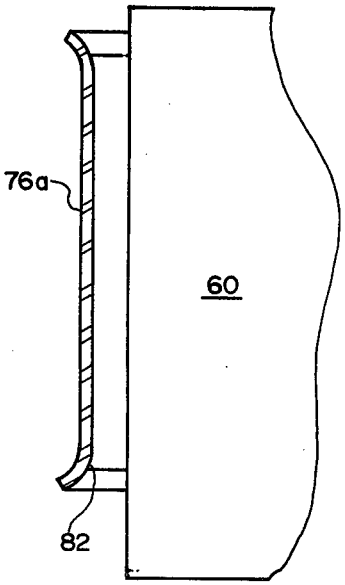
FIG. 7 is a cross-sectional view taken along the line 7—7 of FIG. 5.

A third embodiment of the invention which is used with pairs of spaced-apart, parallel piles 60 or dolphins projecting upwardly above the waterline 62 is illustrated in FIGS. 5 and 6. The piles 60 are secured to each other at their upper ends by conventional bolts 64 and backing plates 66 having nuts 68 torqued onto their ends. The spacing between the pile 60 is maintained by a block 70 positioned between the pile 60. An elongated, cylindrical float 71 is carried by a pair of spaced-apart upper and lower retainers 72, 74 which loosely surround the piles 60 to allow vertical movement along the piles responsive to tidal action.

With reference also, now, to FIG. 5, the retaining members 72, 74 include three annular collars 76, two of which **76*a*, 76*b* loosely surround the piles 60, while the remaining collar 76*c* is secured to the float 71 by bolts 78, nuts 80. As illustrated in FIG. 5, the upper and lower edges of the collars 76 are chamfered outwardly at 82 to prevent the collars 76 from digging into or catching the piles 60 as they move vertically responsive to tidal action. As illustrated in FIG. 6, the collars 76*a*, 76*b* surrounding the piles 60 carry respective mooring eyes 84 to which lines extending from a vessel may be secured. The primary advantage of the embodiment of FIGS. 5 and 6** is that it allows utilization of two piles where additional mooring strength is needed.

Although cylindrical piles 20 are illustrated herein, it is to be understood that piles having other cross-sectional shapes can be used. Also, although wood piles 20 are illustrated herein, piles formed of other materials, such as concrete, may be used. If a different pile cross-section were to be used, such as a steel "H" pile, it may be desirable to change the devices outer shell 44 from round to square, which conforms to the square inside hole requirement needed for the "H" pile. If either the steel or concrete piling are utilized, the usage of rollers and preferably rubber clad rollers are necessary. These rollers would be mounted at both the top and bottom of the inside tube 40 and their use cushions the inside tube 40 from the steel or concrete piling, and not only quiets the impact noises but prevents binding and shock damage to the piling 20.

The inventive floating mooring device thus allows relatively large vessels to be safely and easily moored at conventional moorage facilities.

I claim:

1. A mooring device for use with a pile projecting upwardly in a body of water, said device comprising:

an inner shell adapted to surround said pile, said inner shell having an inside dimension which is sufficiently larger than the diameter of said pile so that said inner shell can loosely slide on said pile;

a float surrounding said shell having sufficient buoyancy to allow said device to float on the surface of said water, said float being formed by a plurality of axially stacked tires concentrically secured to said inner shell by connecting means, said tires being filled with a buoyant material, said connecting means including an annular plate surrounding the upper edges of said inner shell and overlapping the upper side wall of the uppermost tire, said connecting means further including a plurality of circumferentially spaced, elongated fastening members extending through said tires from said annular plate; and mooring means for securing a line extending from a vessel to said device such that said lines may remain taut as said vessel is raised and lowered responsive to tidal action.

2. The mooring device of claim 1, wherein said fastening members include a plurality of tubular spacers embedded in the buoyant material of each tire between vertically aligned holes in the side walls of said tires, said spacers being vertically aligned to receive a rod which extends downwardly from said annular plate to clamp the side walls of adjacent tires between the ends of adjacent spacers.

3. The mooring device of claim 1, wherein said mooring means include a conventional marine anchoring device secured to the upper surface of said annular plate.

4. A mooring device for use with a pair of spaced-apart, parallel piles projecting upwardly in a body of water, said device comprising:

an elongated cylindrical float;

a pair of vertically spaced retainer members secured to said float and loosely surrounding said piles to allow said float to remain on the surface of said water during wave and tidal action, each of said retainer members including three interconnected cylindrical collars, two of which loosely surround respective piles, with the remaining collar being tightly secured to said float; and mooring means for securing a line extending from the vessel to said device such that said lines may remain taut as said vessel is raised and lowered responsive to tidal action.

5. The mooring device of claim 4, further including a connecting plate extending between the collars of each retaining member and wherein said mooring means include a mooring eye projecting from one of the collars loosely surrounding one of said piles.

6. The mooring device of claim 4, wherein the upper and lower edges of each collar surrounding a pile are outwardly chamfered to prevent said collars from binding on said piles as said mooring device moves along the piles responsive to tidal action.

* * * * *